US007942649B2

(12) United States Patent
Lesther et al.

(10) Patent No.: US 7,942,649 B2
(45) Date of Patent: May 17, 2011

(54) ELECTRICALLY DRIVEN PUMP UNIT

(75) Inventors: Nicaïse Lesther, Creteil (FR); Francois Fischer, Bry sur Marne (FR)

(73) Assignee: JTEKT HPI, Chennevieres sur Marne (FR)

( * ) Notice: Subject to any disclaimer, the term of this patent is extended or adjusted under 35 U.S.C. 154(b) by 549 days.

(21) Appl. No.: 11/593,749

(22) Filed: Nov. 7, 2006

(65) Prior Publication Data

US 2007/0122298 A1 May 31, 2007

(30) Foreign Application Priority Data

Nov. 8, 2005 (FR) ..... 05 11333

(51) Int. Cl.
*F04B 17/00* (2006.01)

(52) U.S. Cl. ..... 417/410.4; 417/286; 417/423.5; 417/248

(58) Field of Classification Search ..... 417/3, 248, 417/533, 423.5, 286, 410.4, 426, 427, 16, 417/374; 60/405, 428, 486
See application file for complete search history.

(56) References Cited

U.S. PATENT DOCUMENTS

| | | | | |
|---|---|---|---|---|
| 2,811,930 | A * | 11/1957 | Campbell | 417/16 |
| 2,812,715 | A * | 11/1957 | Redding et al. | 417/79 |
| 3,602,611 | A * | 8/1971 | Oplander | 417/78 |
| 5,178,520 | A * | 1/1993 | Strelow | 417/62 |
| 5,388,761 | A * | 2/1995 | Langeman | 239/1 |
| 6,726,465 | B2 * | 4/2004 | Groleau | 425/214 |
| 2002/0063354 | A1 | 5/2002 | Sulzbach et al. | |
| 2005/0287021 | A1 * | 12/2005 | Ferleyko et al. | 417/417 |

FOREIGN PATENT DOCUMENTS

| | | |
|---|---|---|
| EP | 1 026 392 B1 | 12/2004 |
| GB | 2023731 | 1/1980 |
| JP | 7-243392 | 9/1995 |
| JP | 7-243393 | 9/1995 |

* cited by examiner

*Primary Examiner* — Charles G Freay
*Assistant Examiner* — Todd D Jacobs
(74) *Attorney, Agent, or Firm* — Ladas & Parry LLP

(57) ABSTRACT

An electrical driven pump unit having two hydraulic pumps and two electric motors that are fitted in such a way as to make it possible to obtain the unit's power by adding together the power of the two motors.

10 Claims, 11 Drawing Sheets

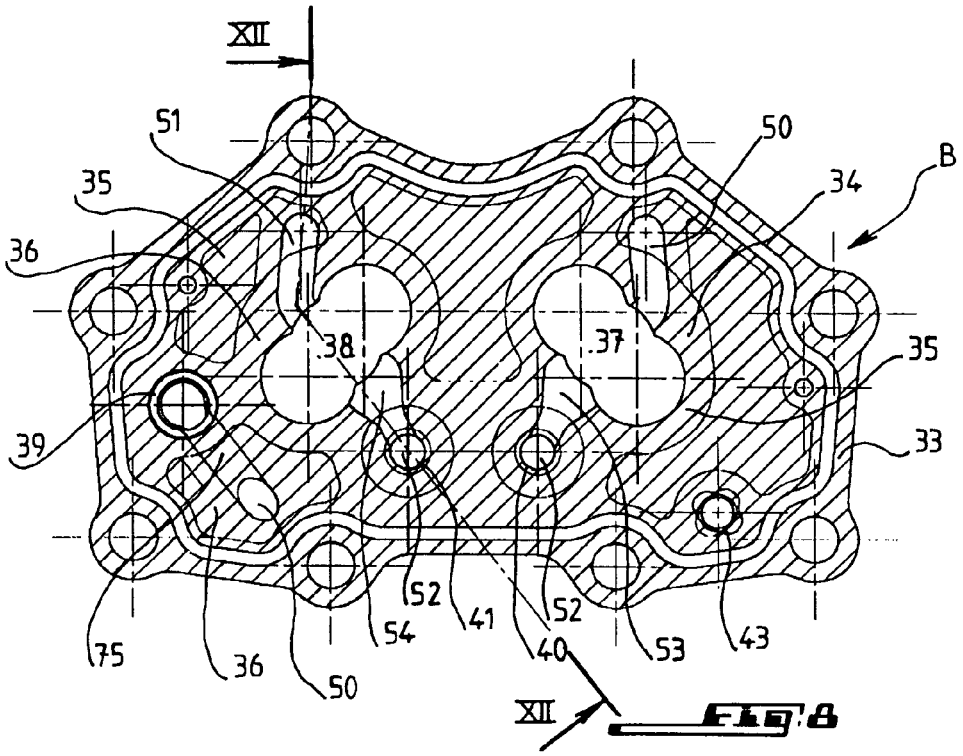
Fig. 8
Fig. 9
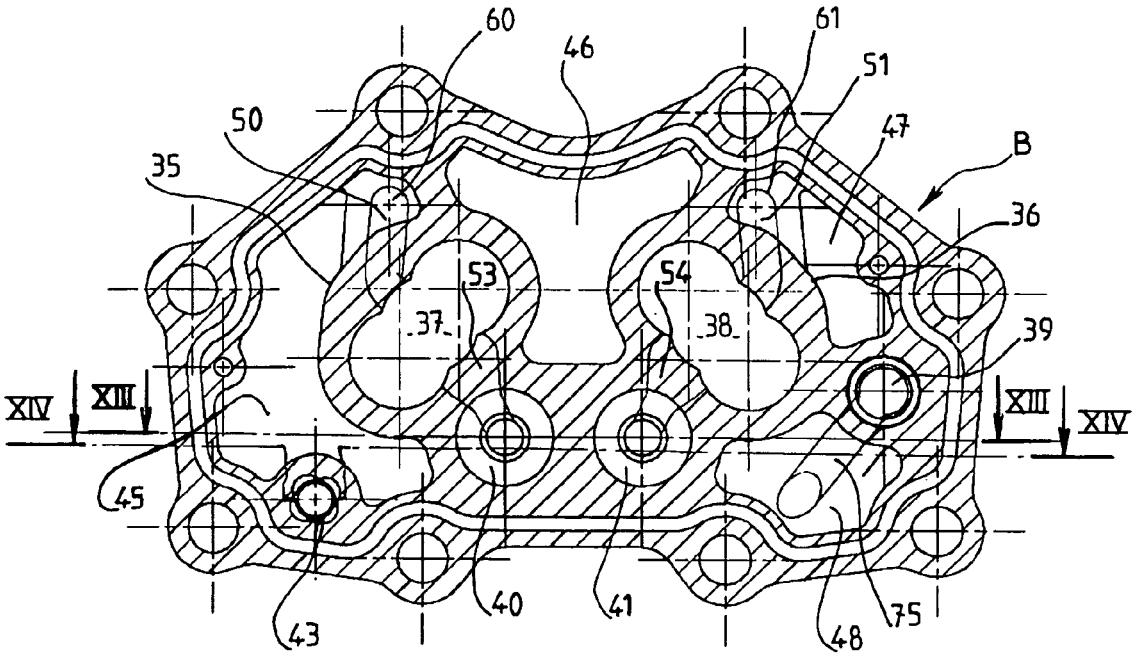

20
17
54
52
55
A
23
57
59
B
51
41
16
18
58
C 24
58
53
55
55
57
59
A
32
43
33
B
12
13
C
63
72
40
68
58
72
41
66

FIG. 15
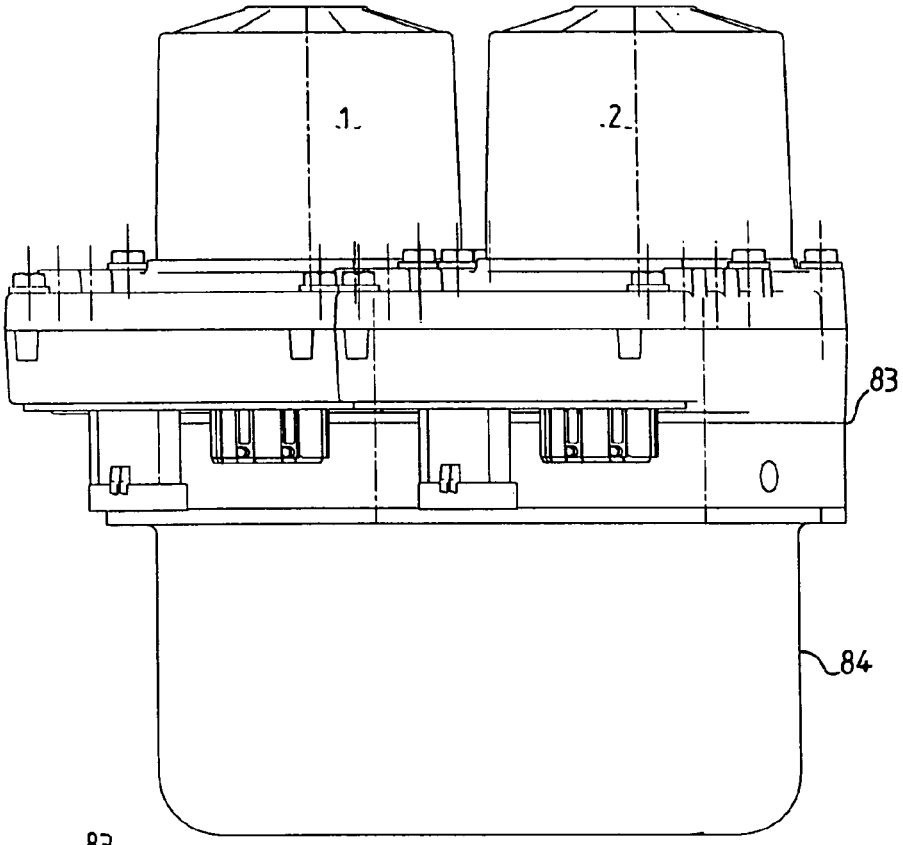
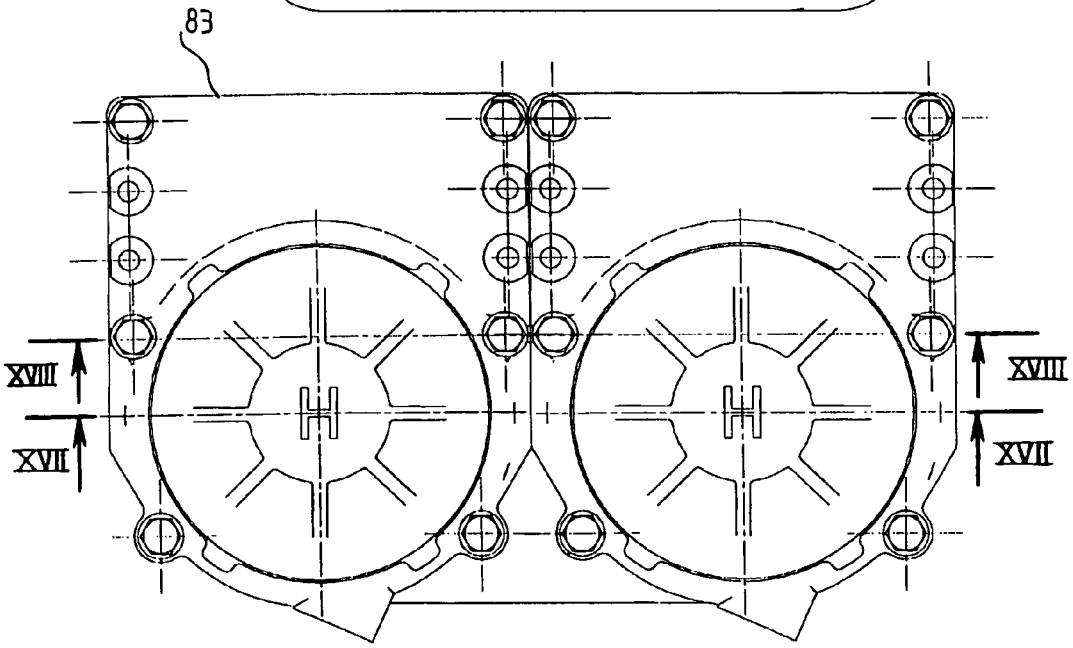
FIG. 16

ELECTRICALLY DRIVEN PUMP UNIT

BACKGROUND OF THE INVENTION

The invention involves an electrically driven pump, of the type consisting of at least one hydraulic pump, particularly with gears, set in revolving motion by a motor device.

Electrically driven pumps of this type, which are known and used in particular by the motor vehicle's power-assisted steering, exhibit the major inconvenience in that the unit's power is limited although the vehicles to be equipped with power-assisted steering are increasingly heavier and the power needed to ensure the power-assisted steering are increasingly higher. Whereas, currently the motor power output of electrically driven pumps is limited for technological reasons, in particular due to the fact that the feed and connector technology do not accept sufficient power, that the technology of high-powered motors (>1.5 kW) is nearly non-existent for a voltage of 12V and that the development of such motors is limited to a small series and represents a major cost.

The purpose of the invention is to get around the inconvenience of known systems.

To achieve this goal, the electrically driven pump according to the invention is characterized in that it consists of two hydraulic pumps and two electric motors that are fitted in such a way as to make it possible to obtain the unit's power by adding together the power of the two motors.

According to a characteristic of the invention, the electrically driven pump is characterized in that it includes a manifold of delivery that consists of a pressure passage common to two pumps.

According to yet another characteristic of the invention, the electrically driven pump is characterized in that the two pumps are integrated into one common pump housing.

According to yet another characteristic of the invention, the electrically driven pump is characterized in that it includes a manifold of suction consisting of a suction passage common to two pumps.

According to yet another characteristic of the invention, the electrically driven pump is characterized in that the prime movers of the two pumps are positioned on either side of the common pump housing.

According to yet another characteristic of the invention, the electrically driven pump is characterized in that the pump housing is positioned sandwich-style between the manifold of suction and the manifold of delivery, each manifold carrying on its outer face one of the two motors.

According to yet another characteristic of the invention, the electrically driven pump is characterized in that the pump housing consists, on the inside of an outer casing wall, of a high pressure volume common to two pumps, which communicates with the working chambers of the two pumps and a common high pressure volume anticipated in the manifold of delivery, which is in communication with the common pressure passage.

According to yet another characteristic of the invention, the electrically driven pump is characterized in that it includes a common supporting sole plate and on one face of which are mounted the two pumps and on the other the two motors.

According to yet another characteristic of the invention, the electrically driven pump is characterized in that the two pumps are enclosed in a common jacket likely to constitute a low-pressure liquid reservoir.

According to yet another characteristic of the invention, the electrically driven pump is characterized in that at least one of the pumps consists, in its path of delivery, of a check valve so that this pump can be stopped selectively.

According to yet another characteristic of the invention, the electrically driven pump is characterized in that it includes a motor piloting device 3 adapted to ensure the piloting of a motor from the outside and in that this motor controls the speed of the other.

According to yet another characteristic of the invention, the electrically driven pump is characterized in that the two motors turn in the same direction or in opposite directions.

According to yet another characteristic of the invention, the electrically driven pump is characterized in that the two pumps are adapted to turn with an angular displaying position of a few degrees to procure a reduction in pressure pulsations produced by the electrically driven pump.

According to yet another characteristic of the invention, the electrically driven pump is characterized in that the two pumps are likely to run opposite phases.

According to yet another characteristic of the invention, the electrically driven pump is characterized in that the pumps run at different rotating speeds.

According to yet another characteristic of the invention, the electrically driven pump is characterized in that the presence of two motors constitutes a means of safety by redundancy.

BRIEF DESCRIPTION OF THE DRAWING FIGURES

The invention will be better understood, and other purposes, characteristics, details and advantages of this invention will appear more clearly in the descriptive explanation that will follow made in reference to the visual drawings attached, given only as an example to illustrate two methods of creating the invention and in which:

FIG. 8 is a cross-section view according to line VIII-VIII of FIG. 2;

FIG. 9 is a cross-section view according to line IX-IX of FIG. 2;

FIG. 15 is a side view of a second method of creating the electrical pump assembly system according to the invention;

FIG. 16 is a top view of FIG. 15.

Figure 19:
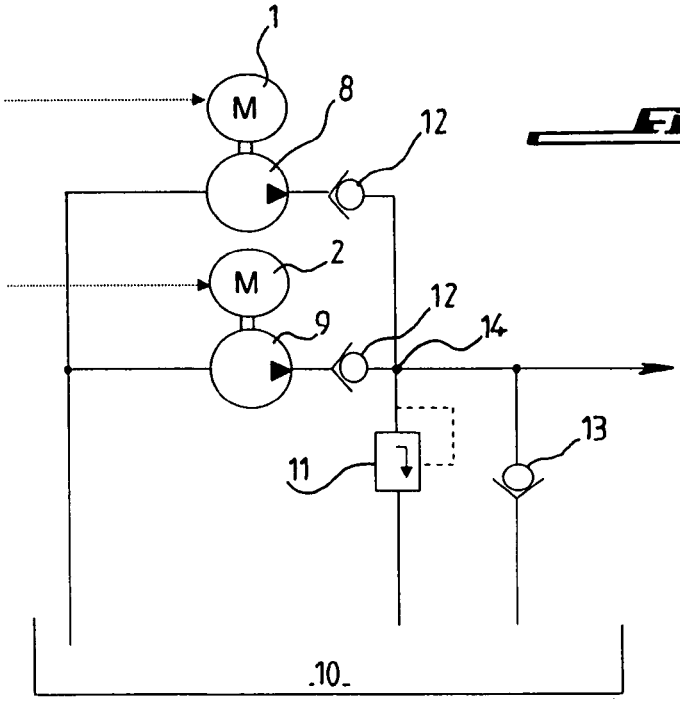

FIG. 19 gives the overview diagram of the system according to the invention, including two electric driving motors of two hydraulic pumps.

DETAILED DESCRIPTION OF THE PREFERRED EMBODIMENTS

Figure 1:
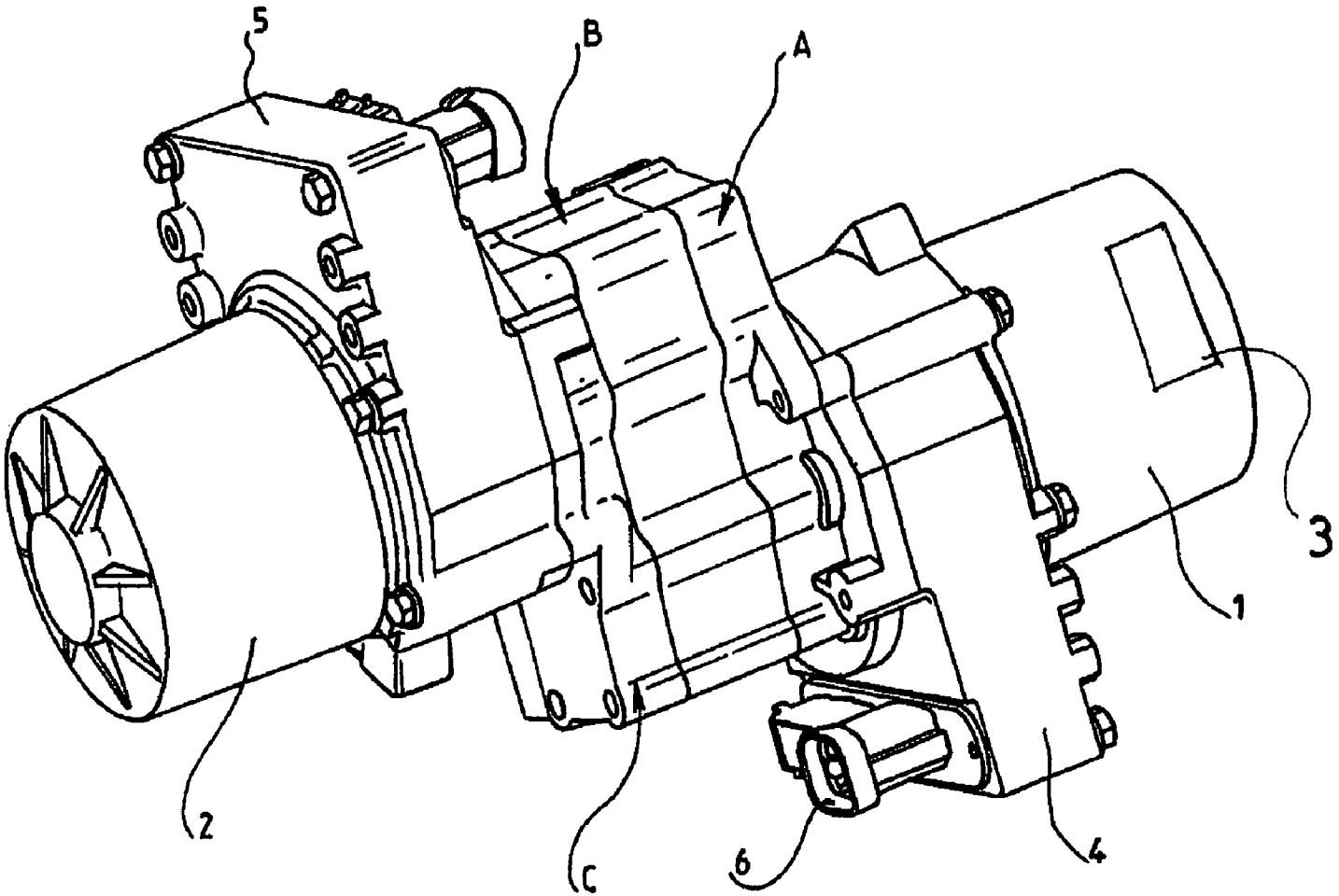
FIG. 1 is a perspective view of an initial method of creating an electrically driven pump system according to the invention.

FIG. 1 is the overall view of an electrically driven pump according to the invention, which includes two electric motors and two hydraulic pumps, each set in motion by one of the two motors. In FIG. 1, references 1 and 2 designate the two electric motors, reference B the pump housing that encloses two hydraulic gear pumps, A the pumps' manifold of inlet or suction and C the manifold of outlet or delivery. As the figures show, the pump housing B is mounted sandwich-style between the manifolds of inlet A and outlet C. These parts form in this way a compact unit positioned between the two motors. Each motor includes a base plate part respectively 4 and 5, which carries the electrical connections 6 of the motors and contains the electrical circuits.

FIG. 19 gives the overview diagram of the system according to FIG. 1. It is noted that motor 1 sets in motion an initial pump designated by reference 8 and the second the motor 2 a second pump 9. The two pumps 8 and 9 suck up the hydraulic fluid into a reservoir 10. The paths of delivery of the two pumps are reunited at the junction point 14 and in this way parallel feed the user in high-pressure hydraulic fluid, generally in oil. In the path of delivery of each pump upstream from the junction point 14 is anticipated a check valve 12. A pressure relief device 11 and a back feeding valve 13 are parallel mounted between the junction point 14 and the reservoir.

By referring to FIGS. 3-11, hereafter will be described the structure of the pump housing B and the manifolds of suction A and delivery C of an initial method of creating the invention.

Figure 2:
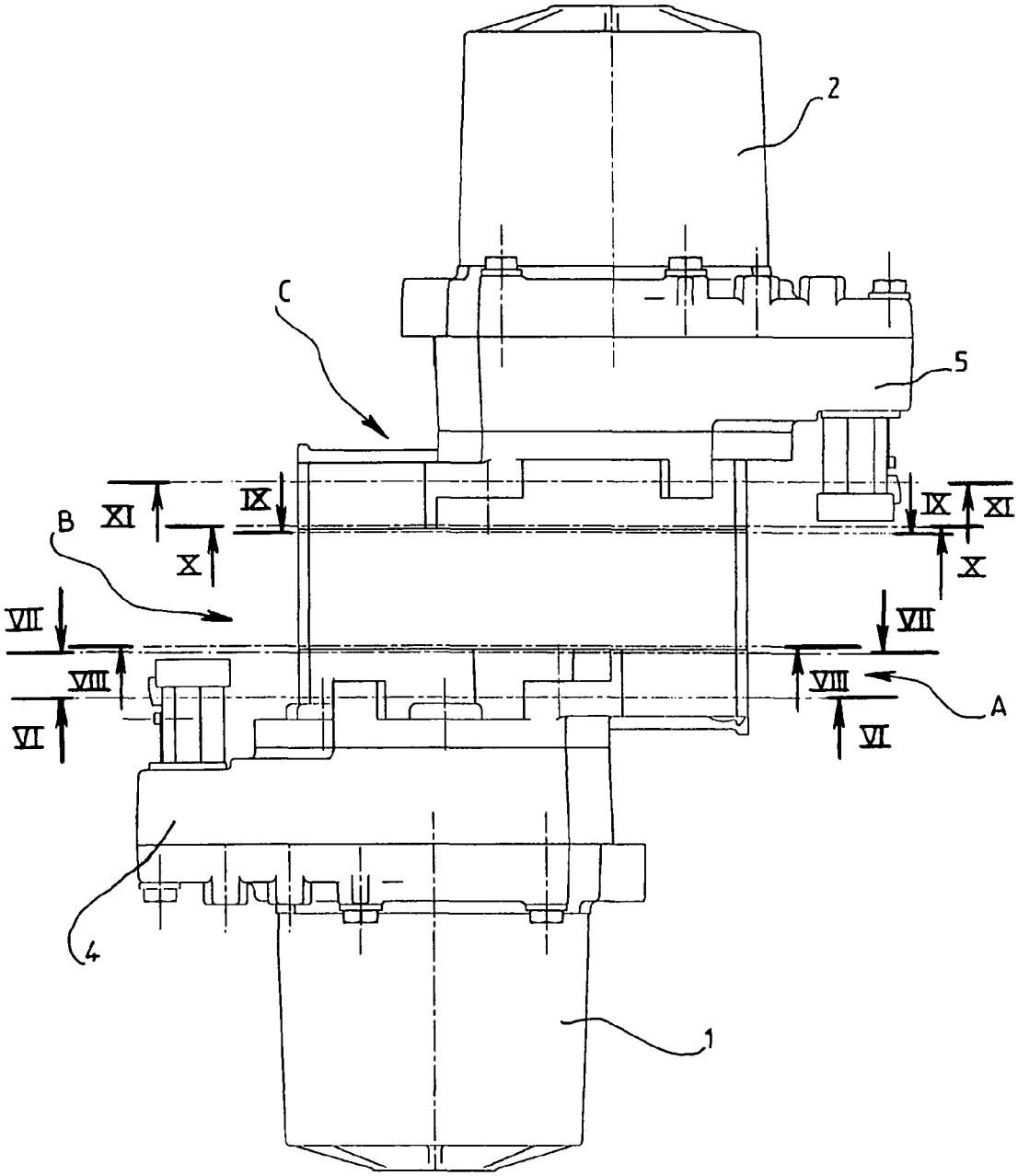
FIG. 2 is a side view of the system represented in FIG. 1.
Figure 3:
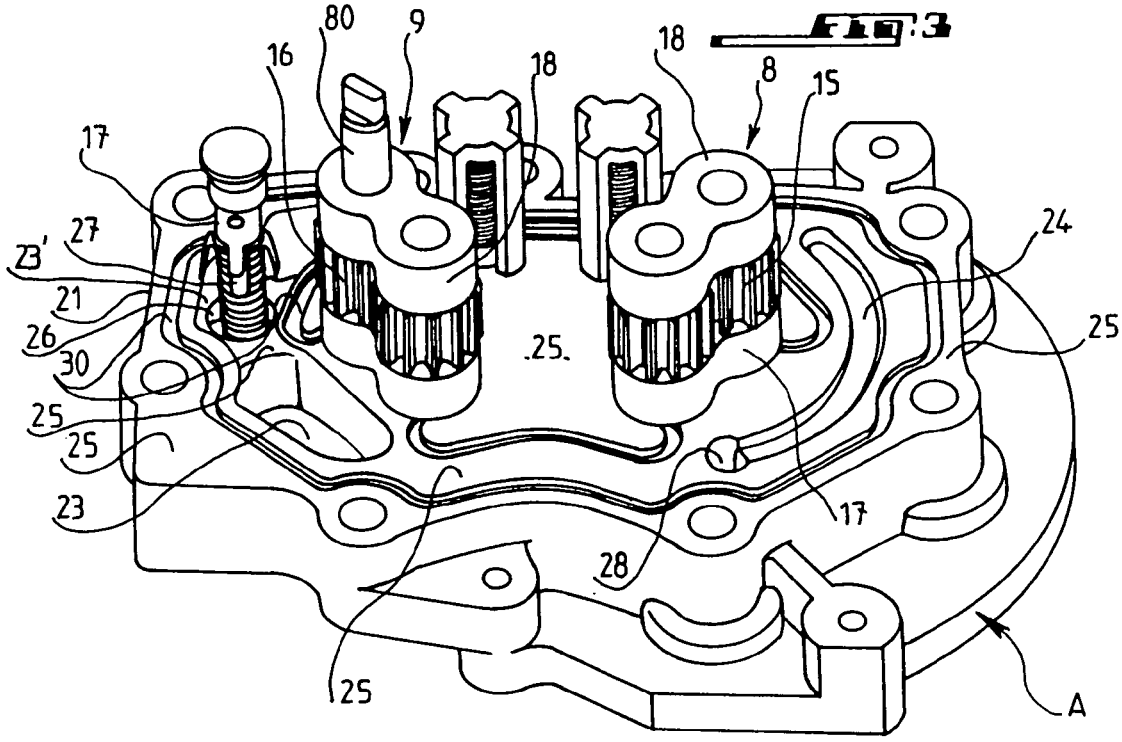
FIG. 3 is a perspective view of the system's manifold of suction indicated on A in FIG. 1 according to the invention; certain parts of the pump module are represented additionally.

FIG. 3 illustrates the structure of the manifold of suction A and also shows the pinions of the cluster gears of the two pumps 8 and 9, noted 15 for the pump 8 and 16 for the pump 9, the pinions are shown with their lower 17 and upper 18 bearings. The presentation of the manifold or support of suction is completed by the two cross-section views 6 and 7 that are made along lines VI-VI and VII-VII indicated in FIG. 2.

The manifold of suction A includes a suction passage 20 that discharges to the outside in the side face 21. This passage 20, which is rectilinear as seen on FIGS. 6 and 7 communicates with the low pressure capacitive cavities 23, 24 dug into the manifold starting from the inner face 25 intended to receive the pump housing B. This suction passage 20 is connected to a reservoir 10 according to FIG. 19, external to the electrically driven pump.

Figure 7:
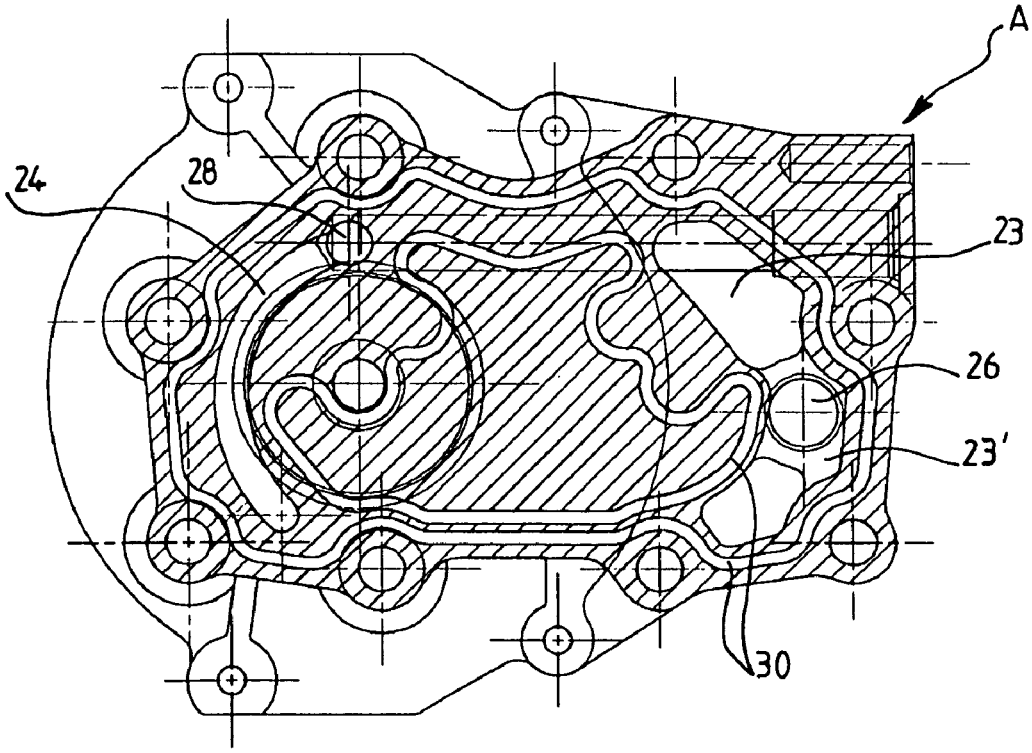
FIG. 7 is a cross-section view along line VII-VII of FIG. 2.

It is noted that the cavity 23 next to the pinions 16 of the pump 9 are broader and deeper than the cavity 24 on the side of the other pump, which is constructed in the form of an arched groove. Cavity 23 exhibits an intermediate area with a raised bottom 23' that delimits a receiving cavity 26 of the spring 27 of the pressure relief device 11 (FIG. 19). The suction passage 20 discharges directly into the cavity 23 and communicates with the cavity 24 through a vertical channel 28, that is to say perpendicular to the cutaway plan. FIG. 7 indicates moreover on 30 grooves in which are placed sealing gaskets not represented. Reference 25 designates the face for positioning the pump housing B.

Figure 6:
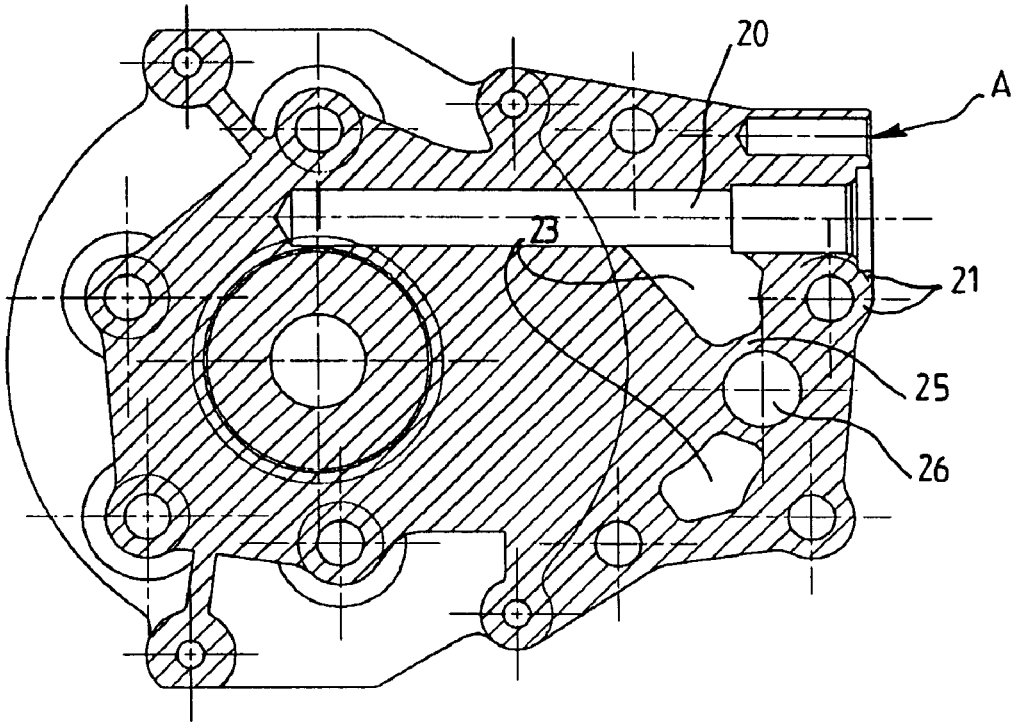
FIG. 6 is a cross-section view along line VI-VI of FIG. 2.

It appears from FIGS. 3, 6 and 7 that the hydraulic fluid, that is to say the oil, after being sucked into the reservoir fills the low pressure cavities 23, 24 to feed independently the two cluster gears 15, 16 as it is illustrated in the perspective figure of the pump housing B and the cross-section views 8 and 9.

Figure 4:
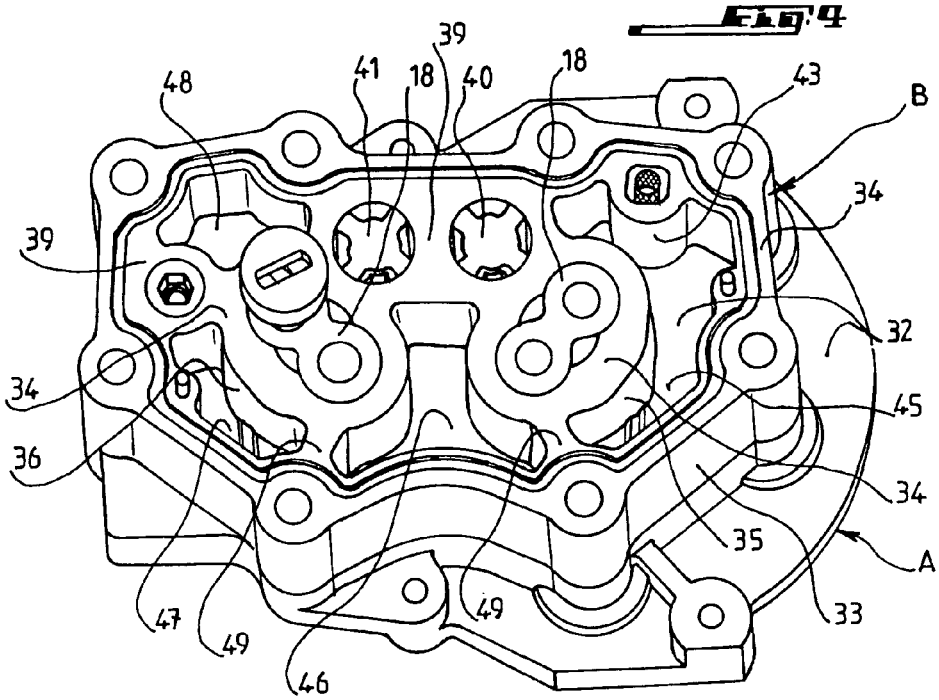
FIG. 4 is a perspective view of the pump housing B of FIG. 1, positioned on the module of suction A.

FIGS. 4, 8 and 9 show that the pump housing B includes a bottom wall 32 which rests on the face for positioning 25 of the manifold of suction A and on which an outer casing wall 33 rises, and inside this casing of the nearly small islands 35, 36 that delimits the housing chambers 37, 38 of the cluster gears 15, 16 and bearings 17, 18, portions in the form of fastening stalks 39 of the nearly small islands to the casing wall 33 configured for creating two cylindrical housings 40, 41 of the two check valves 12 (FIG. 19) as well as the housing 39 in alignment with the cavity 26 for receiving the pressure relieving device 11 (FIG. 19). The casing wall 33 includes a boss, which delimits a cavity 43 intended to receive the back feeding valve 13 (FIG. 19). The remainder of the space inside the casing wall 33 constitutes a capacitive volume consisting of four cavities 45, 46, 47, 48 separated one from the other only by the portions in the form of a stalk and two narrow fastening ribs 49 of the nearly small islands to the casing wall. The front face and surfaces of the nearly small islands, stalks and ribs constitute the face for positioning 34 for the manifold C.

The cross-section views parallel to the plan of the pump housing of FIGS. 8 and 9 show the inlet channels 50 and 51 of the chambers 37 and 38 of the housing of the cluster gears with the bearings of the two pumps and the outlet channels 53 and 54. As it is seen in the cross-section view perpendicular to the plan of the housing B, of FIG. 12, the inlet channel 51 communicates with the low-pressure cavity 23 in which opens the suction passage 20. The inlet channel 50 is connected to the suction passage 20 in a corresponding way, not represented specifically.

Figure 12:
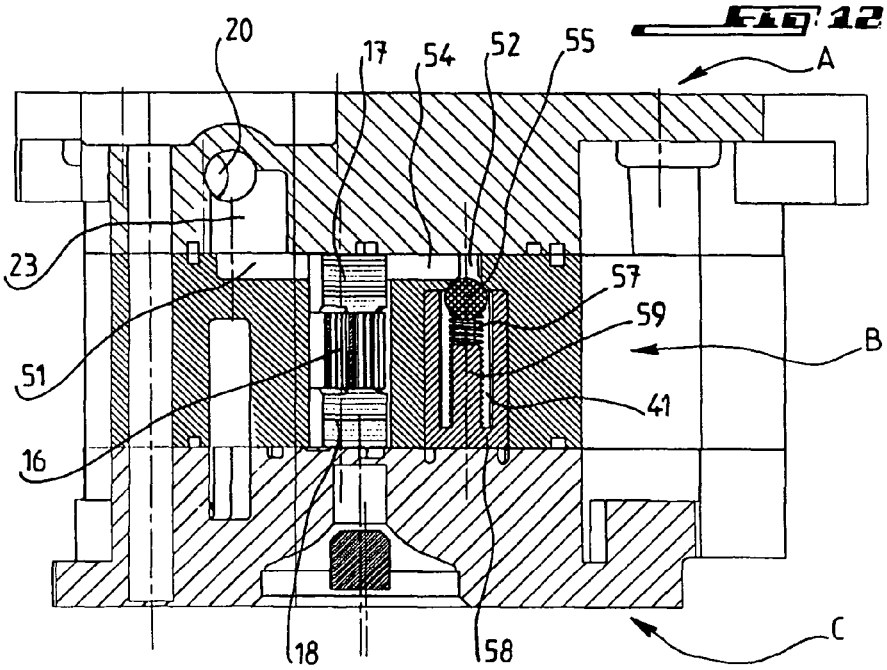
FIG. 12 is a cross-section view of the unit formed by the pump housing B and manifolds A and C in the assembled state according to line XII-XII of FIG. 8.

FIG. 12 also shows that the outlet channel 54 communicates with the housing 41 from one of the two check valves 12, through the hole 52 of the seat of the valve's ball 55. The ball 55 is pushed back onto its seat by a return spring 57 taking hold on its other end onto a base of support 58 while being guided by an item in the shape of a stem 59 of the valve, positioned in the center of the housing 41. The channel of outlet 53 communicates in the same way with the housing 40 of the other check valve 12.

Figure 5:
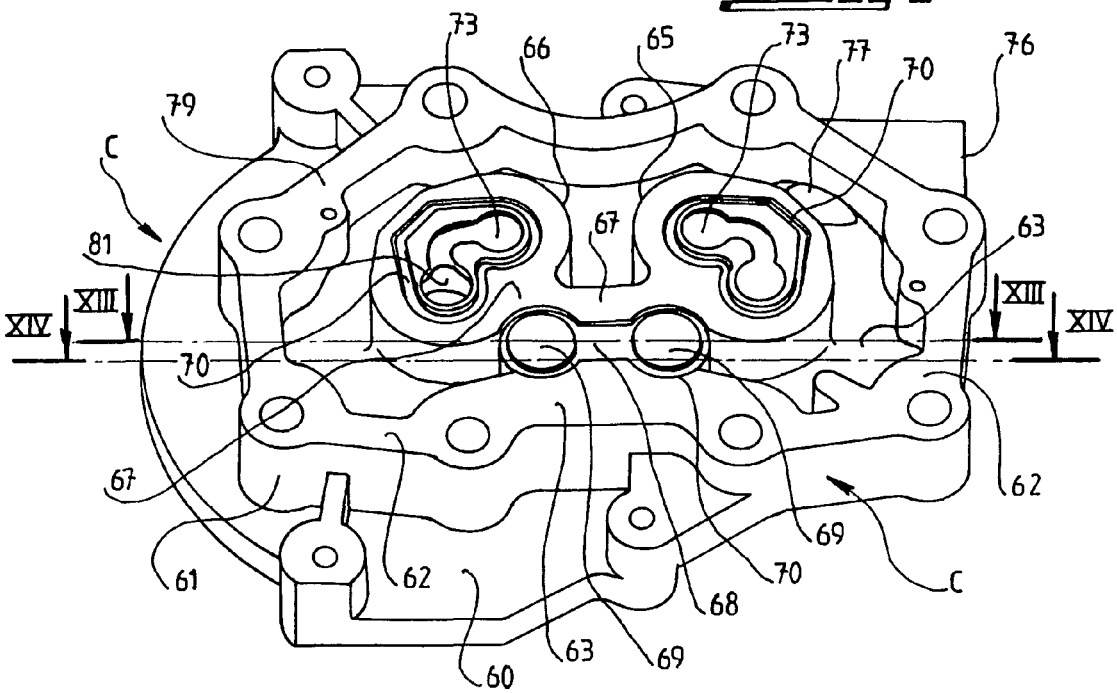
FIG. 5 is a perspective view of the manifold of delivery indicated on C in FIG. 1.
Figure 10:
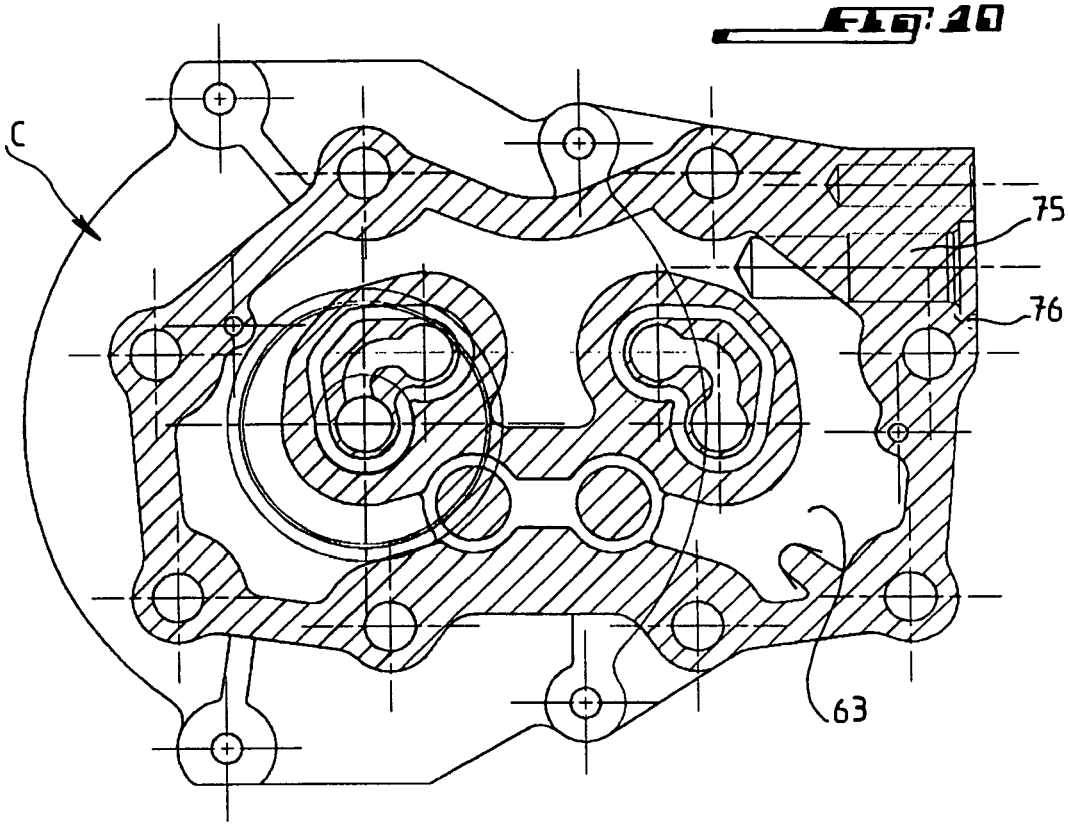
FIG. 10 is a cross-section view according to line X-X of FIG. 2.
Figure 11:
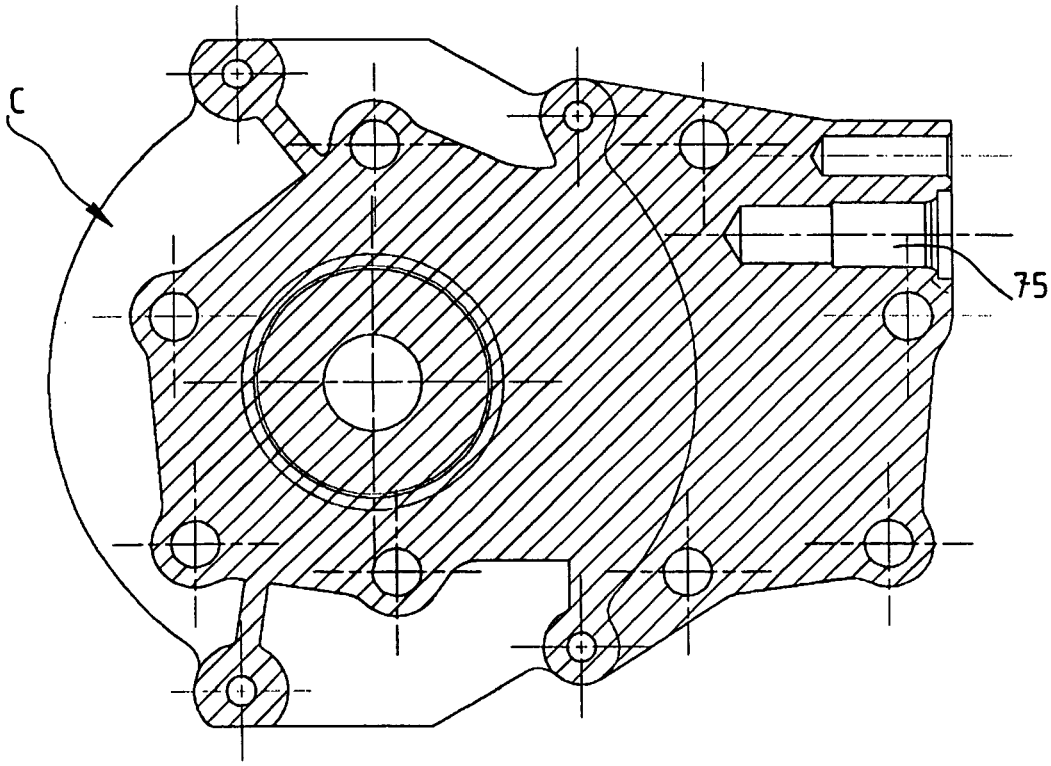
FIG. 11 is a cross-section view according to line XI-XI of FIG. 2.

The perspective FIG. 5 and the cross-section views of FIGS. 10 and 11 illustrate the structure of the manifold or support of delivery C.

The manifold of delivery C consists of a bottom wall 60 on which an outer casing wall 61 rises perpendicularly, which encloses a common capacitive volume 63. The front face 62 of this wall is intended to come rest against the front surface for positioning of the pump housing 34. The volume 63 surrounds two small support islands 65, 66 of the upper bearings 18 of the two cluster gears, these small islands are connected one to the other by a relatively thin bar 67 and, at the level of this bar, at the casing wall 61 by a raised area 68. From this area rise two circular standouts 69 up to the plan level for positioning the manifold. These areas 69 are intended to be used as a bearing surface, each one at the foundation of a spring supporting base 58 of a check valve 12. These are insulated so that these portions and the raised area 68 get narrower, but do not prevent that the oil filling the cavity be able to pass over the area 68 while running out around the stand-outs 69. It is even noted on 70 grooves in the free surface of the small islands 65, 66 for receiving heart-shaped compensation joints that surround the support areas of the bearings 18 of the cluster gear, the hollow parts 73 being filled with low-pressure lubrication oil. In the assembled state of the pump housing B and manifolds A and C, the small islands 65 and 66 of the manifold C are resting against the nearly small islands 35, 36 of the pump housing B.

Figure 13:
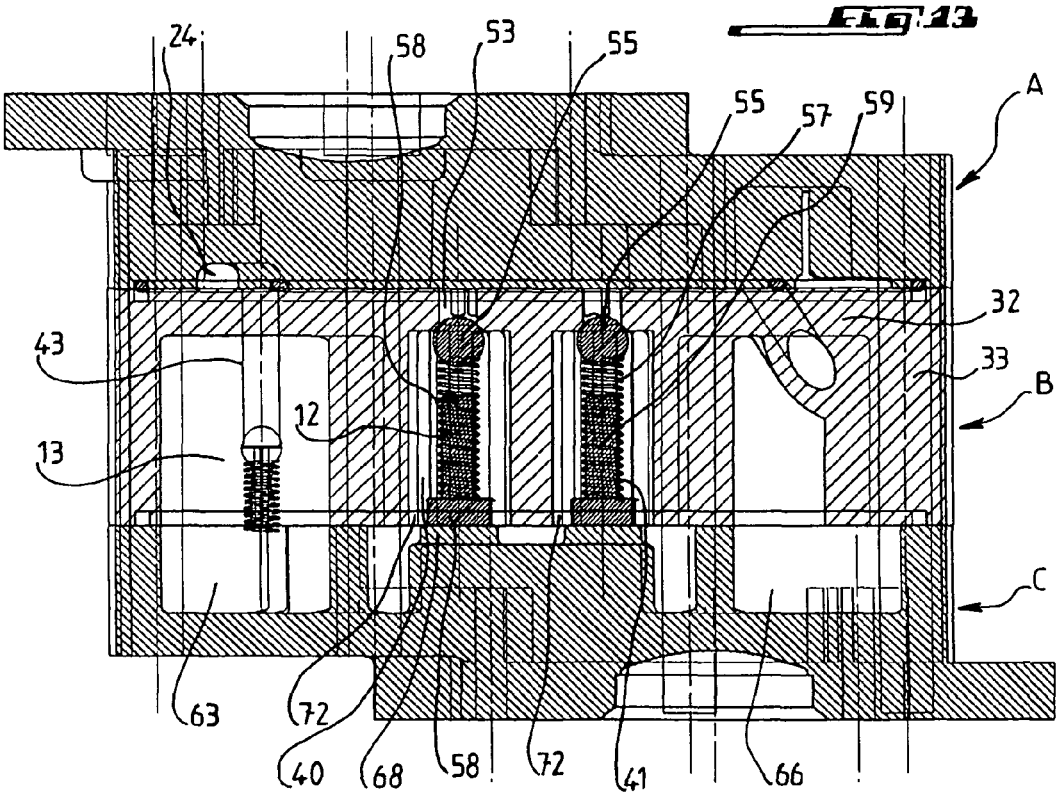
FIG. 13 is a cross-section view of this unit according to line XIII-XIII of FIGS. 8 and 9.
Figure 14:
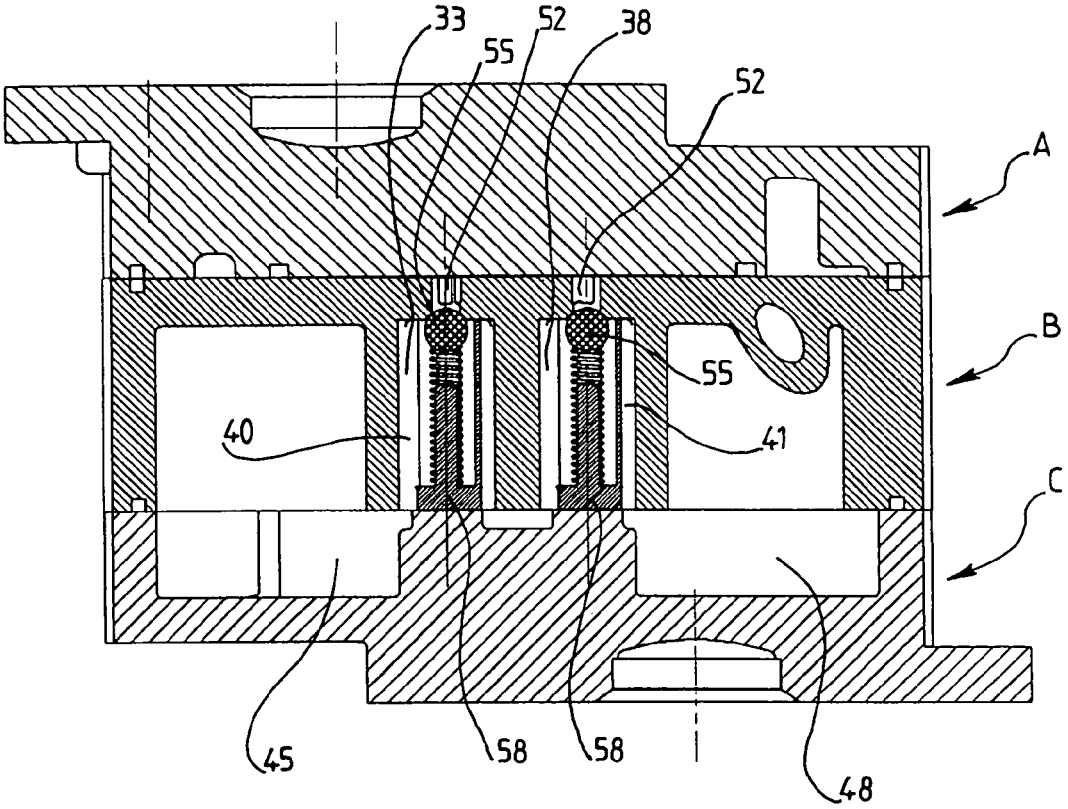
FIG. 14 is a cross-section view of this same unit according to line XIV-XIV of FIGS. 5 and 9.

While referring to the perpendicular cross-section views, of FIGS. 13 and 14, it is noted that the housing cavities 40, 41 of the pump housing B communicate with the volume 63 of the manifold of delivery C, by passages indicated in 72 on both sides and around supporting stand-outs 69 of the check valves.

The cross-section view of FIG. 10 shows that the capacitive volume 63 is in communication with a high-pressure channel of outlet 75, which opens to the outside in the sidewall 76 of the manifold of delivery C. In FIG. 5 the opening towards the outside of the channel of outlet, that is to say of delivery, is not visible, but it is recognized at the bottom of volume 63 on 77 the opening of channel 75 in the volume 63.

Given that the manifold of outlet of delivery C comes, in an assembled state, by its upper face 62 resting against the upper face 34 of the pump housing B, the cavities 45, 46, 47 and 48 of the body B and the volume 63 of the manifold of delivery C constitute only one volume filled with high pressure oil driven back by the pumps 8 and 9 through the pressure passages 53 and 54 (FIG. 9) by passing through the check valves 12 positioned in the chambers 40, 41.

Concerning the pressure relieving device 11 (FIG. 19) it is placed in the cavity 26 of the manifold of suction A (FIGS. 3, 6, 7) and the cavity 39 of the pump housing B (FIGS. 4, 8, 9). The bottom of the cavity 26 is in communication with the space of low pressure suction 23, via a passage not represented and the cavity 39 of the pump housing B communicates via a passage 75 visible on FIGS. 8 and 9 with the high pressure cavity 48 and thus with the pressure passage 75 by the intermediary of the volume 63 of the manifold of delivery C.

With regard to the back feeding valve 13, it is lodged in the cavity 43 of the pump housing B (FIGS. 4, 8, 9) which communicates, as it is seen in FIG. 13, with the low pressure groove 24 of manifold 25 of suction A, on the one hand, and, on the other hand, the volume 63 of the manifold of delivery C In this initial method of completion, the two motors 1 and 2 are positioned on either sides of the unit formed by the two pumps and including the manifolds of suction A and delivery C and, positioned sandwich-style between these two manifolds, the pump housing B. In FIG. 3 on 80 is represented the driving shaft of the motor 2, which is intended to pass through the boring 81 visible in the small island 66 of the manifold of delivery C. Concerning the drive of the cluster gear 15 of the pump 8, it is set in motion by the motor 1 whose shaft will then cross the bottom wall of the manifold of suction A.

Figure 17:
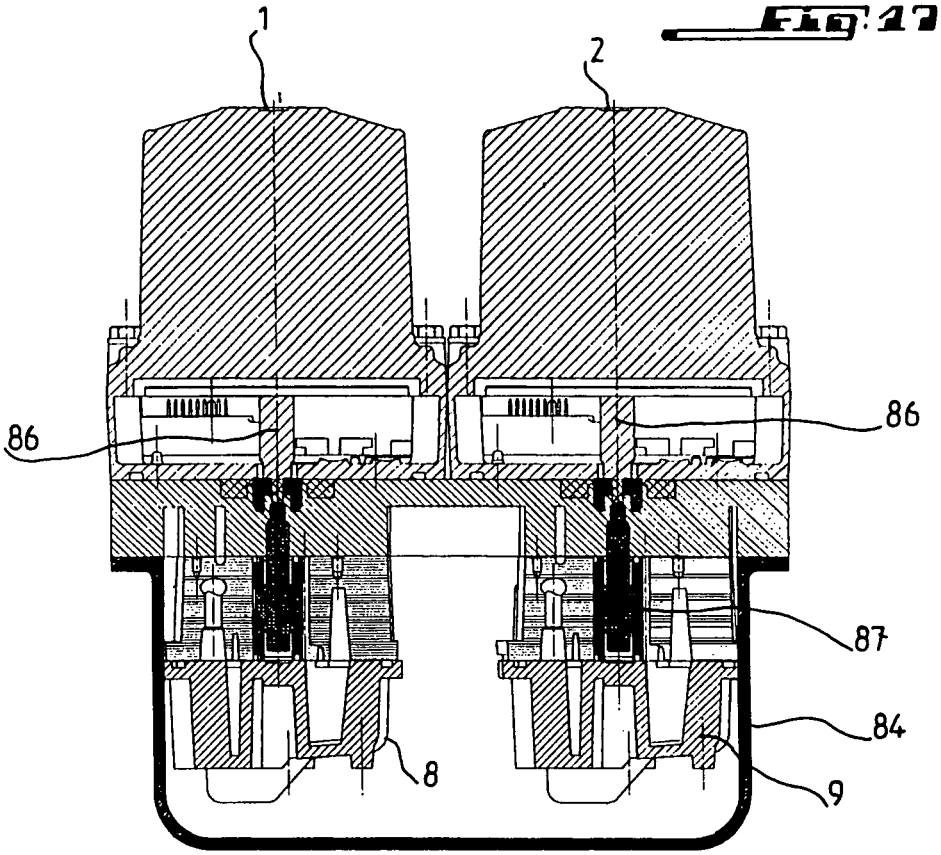
FIG. 17 is a cross-section view along line XVII-XVII of FIG. 16.

FIGS. 15-18 illustrate a second method of creating the electrically driven pump system according to the invention; This method of creating also consists of two motors noted as 1 and 2, each one intended to drive a hydraulic gear pump for example of the type described in the European patent application EP 1 026 392. These two pumps designated by references 8 and 9, as in the initial method of creating, are mounted on a face of a common supporting sole plate 83 and enclosed in a jacket 84 which delimits a low pressure liquid reservoir. The two motors 1, 2 are mounted on the other face of the supporting sole plate 83. The FIG. 17 shows on 86 the motor shafts of the motors 1 and 2, on 87 the leading shafts 15 set in revolving motion by the motor shafts 86.

Figure 18:
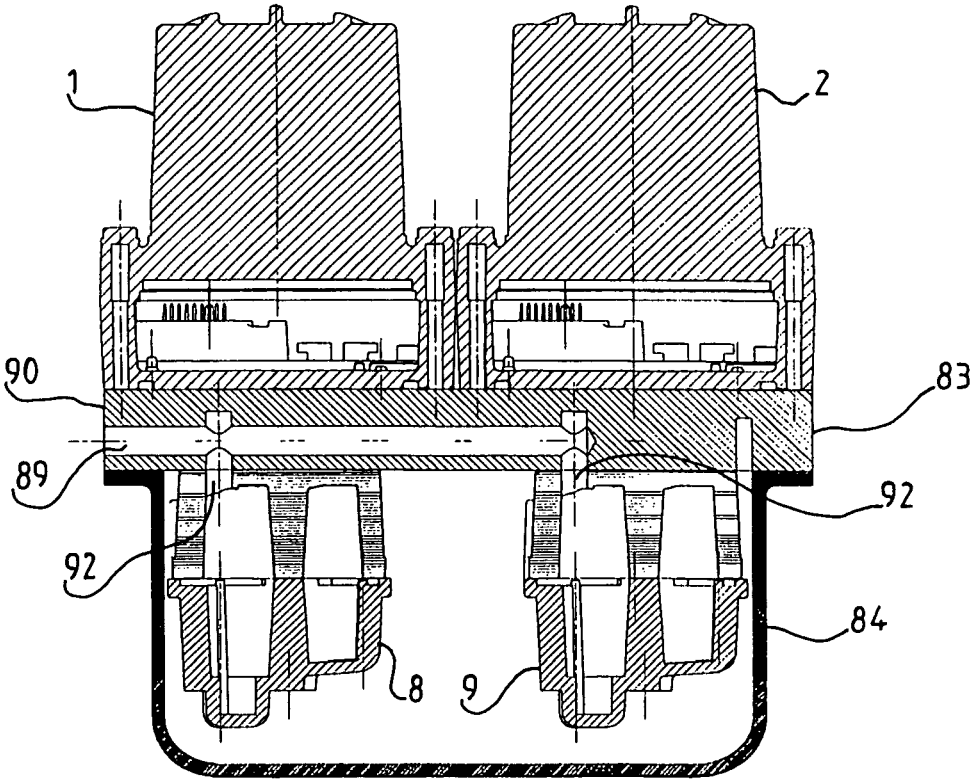
FIG. 18 is a cross-section view along line XVIII-XVIII of FIG. 16.

As it is seen on FIG. 18, the common support 83 of the pumps and motors consists of a passage 89 that opens to the outside in the side face 90 of the support and extends to the inside of the support by passing under the pump 8 up to the pump 9. The pressure passage of the high pressure liquid, designated by the reference 92, of the two pumps discharges into the passage 89 that constitutes therefore the pressure passage common to the two pumps and therefore of the system according to the invention.

It appears from the description of the invention and figures, that these resolve the issue of the increase in power of an electrical pump system while using known technologies. The invention therefore consists of using two motors that are piloted to be able to add together the available power of the two pumps. The invention also allows by setting in motion two different and non-coupled pumps to increase the difference between the minimum and maximum flow of the electrically driven pump. The pumps generally being limited in minimum outflow due to the fact that it is necessary to make them run under a minimum speed, the use of two pumps and two motors allows during low outflow demands, to make only one motor run and decrease the power consumption. Thanks to the presence of a check valve at the outlet side of the pumps, one of the two pumps can be stopped. The invention makes it possible to use motors widely used in series and ensure a redundancy between the two motors, which makes it possible to avoid assisted shutdown upon driving in the event of a breakdown of one of the motors.

Concerning the piloting of the motors, this one is carried out starting from instructions from the vehicle that the electrically driven pump equips. The piloting could be ensured by one of the two motors that would then control the speed of the second.

With the advantage indicated above of the reduction in noise and hydraulic pulsations thanks to the great volume of high-pressure space, is added that the noise and pulsations can yet be reduced thanks to the co-operation of the two pumps. Indeed, each pump generates pulsations of a frequency equal to the number of teeth multiplied by the rotational frequency of the pump. By making that the two pumps turn with a chocking of a few degrees, a reduction occurs in the pressure pulsations, at the same time as an increase in the frequency. According to the invention the motor piloting could be carried out to obtain a running of the pumps opposite phase. The motors could also be monitored at different speeds.

It appears from the description of the two methods of creating the invention, which were only given as an example, that the invention allows, by an integration of the functions of the two pumps to a common pump housing, to reduce the encumbrance of the unit, while anticipating a significant common high pressure volume, which brings, in spite of the presence of two pump units, considerable improvement of the damping of the pulsations produced by these pumps.

The invention claimed is:

1. Electrically driven pump unit comprising two hydraulic pumps and two electric motors, wherein the two pumps are integrated in a common pump housing, and wherein the electrically driven pump unit includes a manifold of delivery equipped with a pressure passage common to the two pumps, and wherein the pump housing is positioned sandwich-style between a manifold of suction and the manifold of delivery, each manifold carrying on its outer face one of the two motors, the motors sandwiching the manifold of delivery, the manifold of suction and the pumps.

2. Electrically driven pump unit comprising two hydraulic pumps and two electric motors, wherein the two pumps are integrated in a common pump housing and have separate paths of delivering which are reunited, wherein the electrically driven pump unit includes a manifold of delivery equipped with a pressure passage common to the two pumps, and a manifold of suction having a suction passage common to the two pumps, and wherein the pump housing is positioned sandwich-style between the manifold of suction and the manifold of delivery, each manifold carrying on its outer face one of the two motors, the motors sandwiching the manifold of delivery, the manifold of suction and the pumps.

3. Electrically driven pump unit according to claim 1, wherein the pump housing includes, on the inside of an outer casing wall a first high pressure volume common to both pumps, wherein said first high pressure volume communicates with working chambers of the two pumps and a second high pressure volume located in the manifold of delivery, wherein the second high pressure volume is in communication with the pressure passage which is common to the two pumps.

4. Electrically driven pump unit according to claim 1, wherein at least one of the pumps includes, in a path of delivery, a check valve so that the at least one pump can be stopped selectively with no backflow.

5. Electrically driven pump unit according to claim 1, wherein the two motors turn in the same direction.

6. Electrically driven pump unit according to claim 1, wherein the two pumps are adapted to turn with an angular shift position of one motor with respect to the angular position of the other motor of a few degrees to procure a reduction in pressure pulsations produced by the electrically driven pump.

7. Electrically driven pump unit according to claim 1, wherein the two motors run with angular positions having opposite phases.

8. Electrically driven pump unit according to claim 1, wherein the pumps run at different rotating speeds.

9. Electrically driven pump unit according to claim 1, wherein the presence of two motors constitutes a means of safety by redundancy.

10. Electrically driven pump unit to claim 1, wherein the two motors are piloted to turn in opposite directions.

* * * * *